US005945776A

United States Patent [19]

Koster et al.

[11] Patent Number: 5,945,776

[45] Date of Patent: Aug. 31, 1999

[54] MOTOR VEHICLE HEADLAMP HAVING LAMP ALIGNED IN REFLECTOR

[76] Inventors: Marinus P. Koster; Arnoldus M. C. Kieboom; Johannes A. A. M. Van Heeswijk, all of Eindhoven, Netherlands

[21] Appl. No.: 08/924,932

[22] Filed: Sep. 8, 1997

[30] Foreign Application Priority Data

Sep. 11, 1996 [EP] European Pat. Off. ..... 96202535
May 26, 1997 [EP] European Pat. Off. ..... 97201589

[51] Int. Cl.[6] ..... H01J 5/54

[52] U.S. Cl. ..... 313/113; 313/318.03; 313/318.05; 313/318.09; 313/318.11; 362/307

[58] Field of Search ..... 373/113, 318.01, 373/318.03, 318.05, 318.06, 318.09, 318.1, 318.11, 318.12, 223; 362/296, 307–310, 341; 439/602, 611

[56] References Cited

U.S. PATENT DOCUMENTS 5,115,381 5/1992 Van Heeswijk ..... 362/61
5,216,319 6/1993 Van Heeswijk ..... 313/318.09
5,320,562 6/1994 Moller ..... 439/613
5,378,958 1/1995 Van Heeswijk ..... 313/318.03
5,412,275 5/1995 Dorsemagen et al. ..... 313/318.01
5,461,277 10/1995 Van Gennip et al. ..... 313/331
5,479,066 12/1995 Willwms et al. ..... 313/318.01
5,527,199 6/1996 Feder et al. ..... 445/49
5,541,471 7/1996 Terheijen et al. ..... 313/112
5,619,135 4/1997 Scholler ..... 313/635

*Primary Examiner*—Ashok Patel

[57] ABSTRACT

The illumination device has a capped electric lamp (1), a reflector (10) and retention means (20) for keeping the lamp (1) fixed to the reflector (10), an electric element (4) of the lamp (1) being aligned with respect to the reflector (10). The cap (5) of the lamp (1) has sphere discs and/or V-shaped grooves as reference means (7) around an axis (3) of its lamp vessel (2), with respect to which the electric element (4) is aligned. The reflector (10) has about an opening (12) for inserting the lamp (1) V-shaped grooves and/or spherical discs as the alignment means (13), cooperating with the reference means of the lamp cap (5). The reference means (7) and the alignment means (13) allow for an easy, fast and reliable mounting of the lamp (1) in the reflector (10), the electric element (4) occupying a predetermined position therein.

4 Claims, 2 Drawing Sheets

MOTOR VEHICLE HEADLAMP HAVING LAMP ALIGNED IN REFLECTOR

BACKGROUND OF THE INVENTION

The invention relates to an illumination device comprising:

(i) an electric lamp provided with:
- a light-transmitting lamp vessel which is closed in a gastight manner and which has an axis;
- an electric element arranged in the lamp vessel;
- a lamp cap provided with contacts and reference locations in a distributed arrangement around the axis, which lamp cap is fixed to the lamp vessel on the axis thereof, the electric element occupying a predetermined position with respect to the reference locations;
- current conductors connected to the electric element, issuing from the lamp vessel to the exterior, and connected to the contacts of the lamp cap; and (ii) an associated reflector provided with:
- a concave reflecting surface;
- an opening for introducing the lamp vessel into the reflector;
- alignment means in a distributed arrangement around the opening for cooperating with reference locations of the lamp cap so as to position the electric element in a predetermined location in the reflector; and furthermore comprising (iii) retention means for keeping the electric lamp with the electric element fixed to the reflector and aligned with respect thereto.

Such an illumination device, a vehicle headlamp assembly, is known from U.S. Pat. No. 5,115,381.

In the known device, the lamp cap has circumference portions in the shape of circular arcs and lying adjacent one another, with respect to which the electric element of the lamp, an incandescent body, is positioned. Around the opening the reflector as two support surfaces lying on the legs of a V for the circular-arc-shaped circumference portions. When the lamp cap is brought into contact with the support surfaces by said circumference portions and is pressed home, the incandescent body will have a predetermined position relative to the reflector in two directions, x and y, transverse to the axis. The lamp cap and the reflector have additional means for achieving that the lamp and the reflector will be joined together in the correct mutual rotational positions. To obtain the desired position of the incandescent body in the reflector, however, the lamp is also to be brought into contact with the reflector in axial direction of the lamp vessel, the z-direction. The reflector has elevations around its opening and the lamp cap has elevations distributed around the axis for achieving an accurate definition of this abutment.

A discharge lamp for use in a reflector of a vehicle headlamp is known from U.S. Pat. No. 5,216,319, where a similarly shaped synthetic-resin lamp cap can be provided in a reflector in a similar manner, with its pair of electrodes in a previously defined position. The lamp cap has a circular circumference with a recess for determining its rotational position in the reflector. To define the depth to which the lamp can enter the reflector, i.e. the location of the electric element in the z-direction, the lamp cap has elevations distributed over a surface which is transverse to the axis, which elevations will abut against the reflector.

Lamps having similar lamp caps for similar uses in reflectors are also known from: U.S. Pat. No. 5,320,562, U.S. Pat. No. 5,461,277, U.S. Pat. No. 5,412,275, U.S. Pat. No. 5,378,958, U.S. Pat. No. 5,527,199, U.S. Pat. No. 5,619,102, U.S. Pat. No. 5,541,471, U.S. Pat. No. 5,479,066, EP-A-0 570 068, EP-A-0 774 158, EP-A-0 710 396, EP-A-0 708 978 and EP-A-0 767 968.

The lamp cap is fixed to the lamp vessel by mechanical means in the above known lamps. A clamping member is for this purpose present around the lamp vessel, retaining the lamp vessel and fixed to the lamp vessel after the electric element had been brought into a predetermined position in relation to the reference locations of the lamp cap. Alternatively, however, the lamp vessel may be connected in the correct alignment to a lamp cap by means of, for example, cement.

It is a disadvantage of the known device and of the known lamps suitable for this device that the lamp cap must be pressed home both in the (x, y) plane and perpendicular thereto, in the z-direction, and that the positioning of the lamp cap can be hampered thereby.

SUMMARY OF THE INVENTION

It is an object of the invention to provide an illumination device of the kind described in the opening paragraph which is of a simple construction rendering possible an accurate positioning of the electric element in the reflector.

According to the invention, this object is achieved in that the reference locations and the alignment means comprise mutually cooperating first, second, and third sphere discs and first, second, and third V-shaped grooves which enclose angles with one another, the grooves tangentially touching the sphere discs in the assembled device, while a surface of the reflector and a surface of the lamp cap supporting the respective alignment means and reference locations lie clear of one another.

In the device according to the invention, either the reference locations at the lamp cap may all be sphere discs, in which case all alignment means are grooves, or the other way about, or the reference locations may be, for example, two sphere discs and one groove, and the alignment means two grooves and one sphere disc, or the other way about.

In the device mentioned in the opening paragraph, the lamp cap has flat elevations which define a flat plane. These elevations form an abutment against the circumference of the reflector for the lamp cap. They thus define the position of the electric element in the z-direction, i.e. the axial direction of the lamp vessel, but not in the x- and y-directions. In the lamp disclosed inter alia in the cited U.S. Pat. No. 5,216,319, the elevations have the shape of thin sphere segments whose tips define a flat plane.

In the device according to the invention, the reference locations and the alignment means by contrast define the position of the electric element in the x- and y- directions as well as in the z-direction. When the reference locations are all brought into contact with a respective alignment means, the lamp can only be introduced into the reflector as far as possible in the axial or z-direction with the electric element in one position in relation to the reflector. Since the electric element is aligned relative to the reference locations, the electric element will then be given its predetermined position. The grooves not only form an abutment in the z-direction for the sphere discs, but they also force the sphere discs to shift in the x, y-plane so as to center the lamp because they enclose angles with one another, i.e. are not parallel. It is favorable when the grooves are directed towards the axis of the lamp vessel. The location of the axis is then defined already by the point of intersection of the extensions of two grooves.

It is necessary for the positioning action of the reference locations and the alignment means that the surfaces on which they are present are not in contact with one another. Unlike in the known device, it is not the tips of elevations, for example the tips of sphere segments, which play a part in the device according to the invention but the flanks of sphere discs oriented towards the surfaces of the V-shaped grooves. Sphere discs are not very vulnerable as reference locations and alignment means, and the same holds for V-shaped grooves. Sharp needle tips, if these were used for cooperating with the bottoms of V-shaped grooves instead of sphere discs, would be unreliable because of their vulnerability.

The reference locations and the alignment means may be present in a regular arrangement distributed around the axis of the lamp vessel, or they may be distributed around the axis in an alternative chosen geometry, for example in a Y-geometry. The latter arrangement may be important for achieving that the lamp cannot be combined with the reflector in several, for example three rotational positions, but only in one. This geometry may also serve to prevent that a lamp is used in combination with a reflector having a shape or size unsuitable for the power or type of lamp in question. Alternatively, for example, an additional, fourth groove and a fourth sphere disc cooperating therewith may serve this purpose.

The reflector may be made of glass or metal, or alternatively of synthetic resin. It is favorable, especially if the reflector is made of glass, when the alignment means are all grooves, because grooves are even more robust and less vulnerable in glass than are elevations such as sphere discs. The reflecting surface may have various shapes, for example paraboloidal or ellipsoidal. The opening in the reflector may or may not be on the optical axis of the reflecting surface. The reflector may have a neck-shaped portion in which this opening is present.

The electric lamp may be an incandescent lamp or a discharge lamp, for example a high-pressure discharge lamp, for example comprising metal halides in its filling, with a glass, for example hard-glass or quartz glass lamp vessel, or a ceramic lamp vessel, for example made of aluminum oxide. The electric element, for example an incandescent body or a pair of electrodes in an ionizable medium, may be arranged, for example, axially or transversely in the lamp vessel.

The lamp cap may be made substantially of metal, with insulation material around the contacts, of synthetic resin such as, for example, polyphenylene sulphide, or of ceramic material such as, for example, steatite. The lamp vessel may be mechanically fixed to and aligned with the lamp cap, for example, as in the known lamps mentioned above, or alternatively by means of cement.

The retention means for fixing the electric lamp with its electric element in alignment with the reflector may be, for example, resilient members at the reflector which grip around the positioned lamp cap, as is usual in automobile headlamps, or, for example, a union nut which grips around an edge of the lamp cap and can be fixed to studs or a screwthread of the reflector.

The illumination device according to the invention may be used, for example, as a floodlight, as a vehicle headlamp, for projection purposes, or for creating spot lighting.

BRIEF DESCRIPTION OF THE DRAWINGS

An embodiment of the illumination device according to the invention is shown in the drawing, in which.

DETAILED DESCRIPTION OF THE PREFERRED EMBODIMENTS

Figure 1:
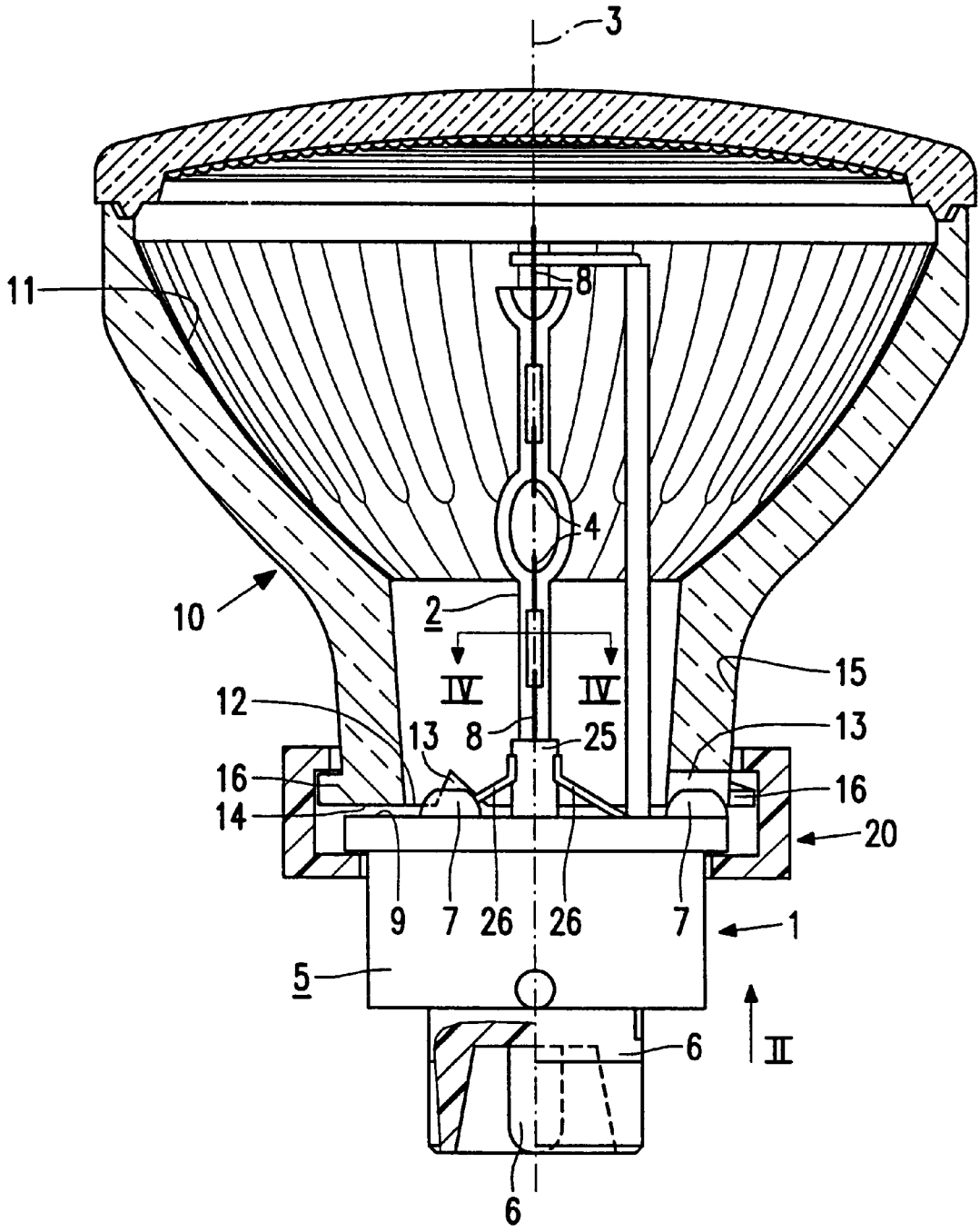
FIG. 1 shows the illumination device partly in side elevation, partly in cross-section.

In FIG. 1, the illumination device comprises an electric lamp 1 with a lamp vessel 2, made of quartz glass in the Figure, which is closed in a gastight manner, which transmits light, and which has an axis 3. An electric element 4, a pair of electrodes in an ionizable medium such as, for example, rare gas and metal halides, possibly with mercury as a buffer gas in the Figure, is arranged in the lamp vessel 2. A lamp cap 5, made of synthetic resin in the Figure, for example polyphenylene sulphide, is provided with contacts 6, has reference locations 7 in a distributed arrangement around the axis 3, and is fixed to the lamp vessel 2 on the axis 3 thereof. The electric element 4 here occupies a predetermined position with respect to the reference locations 7. Current conductors 8 connected to the electric element 4 issue from the lamp vessel 2 to the exterior and are connected to the contacts 6 of the lamp cap 5, which contacts are formed by a central pin and a cylindrical ring concentric therewith in the Figure. The device further comprises an associated reflector 10 which has a concave reflecting surface 11, for example owing to the presence of a metal layer, for example of Al, or a dichroic mirror, and an opening 12 for introducing the lamp vessel 2 into the reflector 10. Distributed around the opening 12, there are alignment means 13 for cooperation with reference locations 7 of the lamp cap 5 so as to position the electric element 4 in a defined location in the reflector 10. The device further comprises retention means 20 for keeping the electric lamp 1 with its electric element 4 fixed to and aligned with the reflector 10.

The reference locations 7 and the alignment means 13 comprise mutually cooperating first, second, and third sphere discs and first, second, and third V-shaped grooves which enclose angles with one another, the grooves touching the sphere discs tangentially in the assembled device. A surface 14 of the reflector 10 and a surface 9 of the lamp cap 5, supporting the alignment means 13 and the reference locations 7, respectively, lie clear of one another. In the Figure, see also FIG. 2, the grooves are directed towards the axis 3 of the lamp vessel 2.

In the Figure, the reflector 10 has a neck-shaped portion 15 in which the opening 12 is present, and also an axis of symmetry which coincides with the axis 3. An optical center of the reflector 10 coincides with the electric element 4. The reflector 10 has projections 16 at its neck-shaped portion 15, with which projections the retention means 20, a union nut in the Figure, cooperate.

Figure 4:
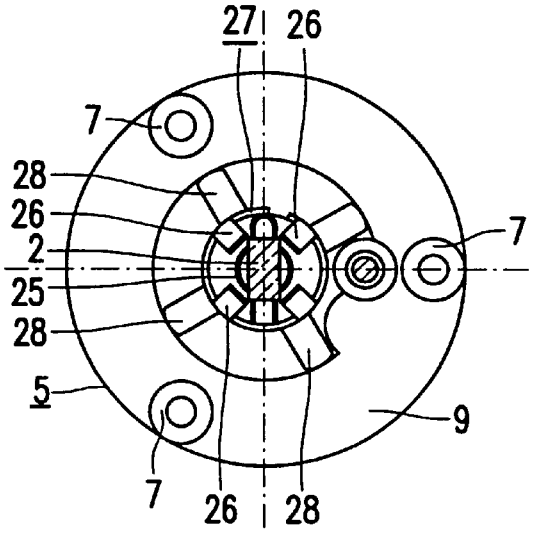
FIG. 4 is a cross-section through the lamp taken on the line IV—IV in FIG.

A clamping member 25 is present around the lamp vessel 2, see also FIG. 4, to which member tags 26 of a coupling member 27, see FIG. 4, are welded after the electric element 4 has been brought into the predetermined position relative to the reference locations 7 of the lamp cap 5. The coupling member 27 shown is held clamped in the lamp cap 5 by clamping tags 28.

Figure 2:
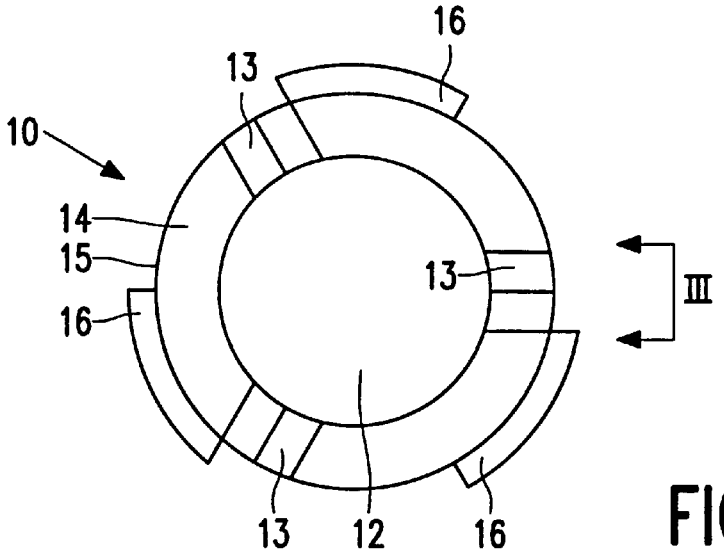
FIG. 2 shows a surface of the reflector viewed along II in FIG. 1.
Figure 3:
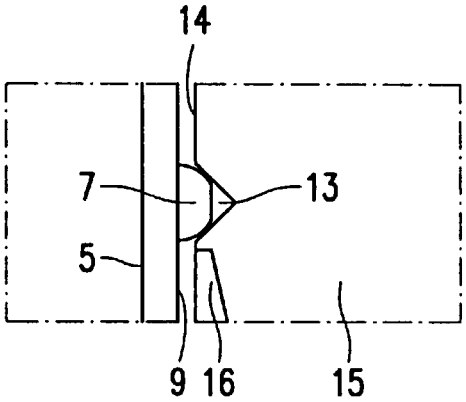
FIG. 3 shows a detail of the reflector viewed along III in FIG. 2, with a detail of a lamp cap provided against it.

In FIG. 1, see also FIG. 2, the alignment means 13 are grooves and the reference locations 7 are sphere discs, see also FIG. 4. As is apparent from FIG. 3, the missing sphere segments could be present without having any useful effect, but also without causing any interference. The alignment means 13, see FIG. 2, are regularly spaced over the circumference of the opening 12 in the reflector 10, as are the reference locations 7 of the lamp cap 5, see FIG. 4. In the embodiment shown, see FIG. 1, the electric lamp 1 can accordingly be combined with the reflector 10 into the illumination device in three rotational positions. The electric element 4, however, will always occupy the same position in the reflector 10 when the lamp 1 is introduced as deeply as possible into the reflector 10. The alignment means 13 in fact center the lamp 1 then in the plane of drawing of FIG. 2.

We claim:

1. An illumination device comprising:

(i) an electric lamp (1) provided with:

a light-transmitting lamp vessel (2) which is closed in a gastight manner and which has an axis (3);

an electric element (4) arranged in the lamp vessel (2);

a lamp cap (5) provided with contacts (6) and reference locations (7) in a distributed arrangement around the axis (3), which lamp cap (5) is fixed to the lamp vessel (2) on the axis (3) thereof, the electric element (4) occupying a predetermined position with respect to the reference locations (7);

current conductors (8) connected to the electric element (4), issuing from the lamp vessel (2) to the exterior, and connected to the contacts (6) of the lamp cap (5); and (ii) an associated reflector (10) provided with:

a concave reflecting surface (11);

an opening (12) for introducing the lamp vessel (2) into the reflector (10);

alignment means (13) in a distributed arrangement around the opening (12) for cooperating with reference locations (7) of the lamp cap (5) so as to position the electric element (4) in a predetermined location in the reflector (10); and furthermore comprising (iii) retention means (20) for keeping the electric lamp (1) with the electric element (4) fixed to the reflector (10) and aligned with respect thereto, wherein the reference locations (7) and the alignment means (13) comprise mutually cooperating first, second, and third sphere discs and first, second, and third V-shaped grooves which enclose angles with one another, the grooves tangentially touching the sphere discs in the assembled device, while a surface (14) of the reflector (10) and a surface (9) of the lamp cap (5) supporting the respective alignment means (13) and reference locations (7) lie clear of one another.

2. An illumination device as claimed in claim 1, wherein the reflector (10) has a neck-shaped portion (15) in which the opening (12) is present.

3. An illumination device as claimed in claim 1, wherein the grooves are directed towards the axis (3) of the lamp vessel (2).

4. An illumination device as claimed in claim 1, wherein the alignment means (13) are grooves and the reference locations (7) are sphere discs.

* * * * *